US011478902B2

(12) United States Patent
Zhong et al.

(10) Patent No.: US 11,478,902 B2
(45) Date of Patent: Oct. 25, 2022

(54) PLIERS WITH IMPROVED JOINT DESIGN

(71) Applicant: APEX BRANDS, INC., Apex, NC (US)

(72) Inventors: Junwei Zhong, Rizhao (CN); Fengping Zhu, Shanghai (CN); Zhihong Fu, Cary, NC (US); Chen-Hsun Chou, Perry Hall, MD (US)

(73) Assignee: APEX BRANDS, INC., Apex, NC (US)

( * ) Notice: Subject to any disclaimer, the term of this patent is extended or adjusted under 35 U.S.C. 154(b) by 0 days.

(21) Appl. No.: 17/276,578

(22) PCT Filed: Sep. 18, 2018

(86) PCT No.: PCT/CN2018/106099
§ 371 (c)(1),
(2) Date: Mar. 16, 2021

(87) PCT Pub. No.: WO2020/056571
PCT Pub. Date: Mar. 26, 2020

(65) Prior Publication Data

US 2021/0308838 A1 Oct. 7, 2021

(51) Int. Cl.
*B25B 7/08* (2006.01)
*B25B 7/22* (2006.01)

(52) U.S. Cl.
CPC . *B25B 7/08* (2013.01); *B25B 7/22* (2013.01)

(58) Field of Classification Search
CPC .... B25B 7/00; B25B 7/02; B25B 7/08; B25B 7/12; B25B 7/18; B25B 7/20; B25B 7/22; A61C 7/00; A61C 7/04; B25C 11/02
See application file for complete search history.

(56) References Cited

U.S. PATENT DOCUMENTS 832,200 A * 10/1906 Kellemen ..... B25B 7/08 81/416
2,939,214 A * 6/1960 Andersson ..... B26B 17/00 81/416

(Continued)

FOREIGN PATENT DOCUMENTS

CN 101890681 A 11/2010
CN 102019590 A 4/2011

(Continued)

OTHER PUBLICATIONS

International Search Report and Written Opinion from related international application PCT/CN2018/106099, dated Mar. 28, 2019, all pages cited in its entirety.

*Primary Examiner* — Robert J Scruggs
(74) *Attorney, Agent, or Firm* — Burr & Forman LLP

(57) ABSTRACT

A hand tool (100) includes a head section (102) including a top jaw (106) and a bottom jaw (108), a handle section (104) including a top handle (112) and a bottom handle (114), and a joint assembly coupling the head section (102) to the handle section (104). The top jaw (106) is coupled to the bottom handle (114) by a first transition portion, and the bottom jaw (108) is operably coupled to the top handle (112) by a second transition portion. The first and second transition portions are pivotally coupled to each other by a pivot pin (140). The first transition portion is disposed on a first side of a longitudinal centerline of the hand tool (100), and at least a majority of the second transition portion is disposed on a second side of the longitudinal centerline such that a width of the first transition portion is less than a width of the second transition portion.

13 Claims, 5 Drawing Sheets

(56) References Cited

U.S. PATENT DOCUMENTS

| | | | | | |
|---|---|---|---|---|---|
| 4,843,927 | A * | 7/1989 | Gulistan | B25B 7/06 | 81/416 |
| 5,220,856 | A * | 6/1993 | Eggert | B25B 7/08 | 81/416 |
| 5,745,997 | A * | 5/1998 | Berg | B25F 1/04 | 7/128 |
| 5,862,552 | A * | 1/1999 | Koelewyn | B25B 7/08 | 7/132 |
| 6,708,359 | B2 * | 3/2004 | Butts | A01K 95/02 | 7/106 |
| 2004/0159194 | A1 * | 8/2004 | Ting | B25B 7/06 | 81/416 |
| 2006/0236823 | A1 * | 10/2006 | MacLain | B25B 7/22 | 81/418 |
| 2016/0129561 | A1 * | 5/2016 | Chen | B25B 7/08 | 76/119 |

FOREIGN PATENT DOCUMENTS

| | | | |
|---|---|---|---|
| CN | 105458955 | A | 4/2016 |
| DE | 19963818 | A1 | 7/2001 |
| GB | 1321268 | A | 6/1973 |

* cited by examiner

PLIERS WITH IMPROVED JOINT DESIGN

TECHNICAL FIELD

Example embodiments generally relate to hand tools and, in particular, relate to solid joint pliers that are provided with an improved joint.

BACKGROUND

Hand tools are commonly used across all aspects of industry and in the homes of consumers. Hand tools are employed for multiple applications including, for example, tightening, component joining, and/or the like. For some component joining applications, a solid join pliers (e.g., a pliers that does not have a slip joint, tongue-and-groove, channel lock, or other adjustable joint) may be preferred.

Solid joint pliers typically have serrated jaws that are aligned with each other to grip an object placed therebetween when handles to which the jaws are attached are compressed toward each other. When held such that the jaws and handles are aligned with each other in a vertical plane, the bottom jaw is typically attached to the top handle and the top jaw is attached to the bottom handle. The transition between the handles and respective jaws (and between the respective top and bottom positions) occurs at a joint portion of the pliers, where opposing right and left halves of the joint portion interface with each other and overlap each other. The right and left halves also pivot relative to each other about a joining pin that forms an axis of rotation about which the handles (and jaws) pivot during compression and release of the handles.

In a typical solid joint pliers, the aforementioned vertical plane may extend through a longitudinal centerline of the handles and jaws, and may exactly pass through or define the interface between the surfaces of the right and left halves of the joint portion. Moreover, the left and right halves may be exactly equal in width to each other. The joining pin is then often formed using a rivet joint. This design is relatively simple and straightforward to implement. However, the rivet joint can wear out over time, or even be damaged.

Thus, it may be desirable to develop an improved joint design for a solid joint pliers.

BRIEF SUMMARY OF SOME EXAMPLES

In an example embodiment, a hand tool may be provided. The hand tool may include a head section including a top jaw and a bottom jaw, a handle section including a top handle and a bottom handle, and a joint assembly operably coupling the head section to the handle section. The top jaw is operably coupled to the bottom handle by a first transition portion of the joint assembly, and the bottom jaw is operably coupled to the top handle by a second transition portion of the joint assembly. The first and second transition portions may be pivotally coupled to each other by a pivot pin. The first transition portion may be disposed on a first side of a longitudinal centerline of the hand tool, and at least a majority of the second transition portion is disposed on a second side of the longitudinal centerline such that a width of the first transition portion in a direction of a pivot axis of the pivot pin is less than a width of the second transition portion.

In another example embodiment, a hand tool may be provided. The hand tool may include a head section including a top jaw and a bottom jaw, a handle section including a top handle and a bottom handle, and a joint assembly operably coupling the head section to the handle section. The top jaw may be operably coupled to the bottom handle by a first transition portion of the joint assembly, and the bottom jaw may be operably coupled to the top handle by a second transition portion of the joint assembly. The first and second transition portions may be pivotally coupled to each other by a pivot pin. The first transition portion may be disposed on a first side of a longitudinal centerline of the hand tool, and at least a majority of the second transition portion may be disposed on a second side of the longitudinal centerline. The pivot pin may include a welding pin that is welded to one of the first transition portion or the second transition portion.

BRIEF DESCRIPTION OF THE SEVERAL VIEWS OF THE DRAWING(S)

Having thus described some example embodiments in general terms, reference will now be made to the accompanying drawings, which are not necessarily drawn to scale, and wherein:

DETAILED DESCRIPTION

Figure 1:
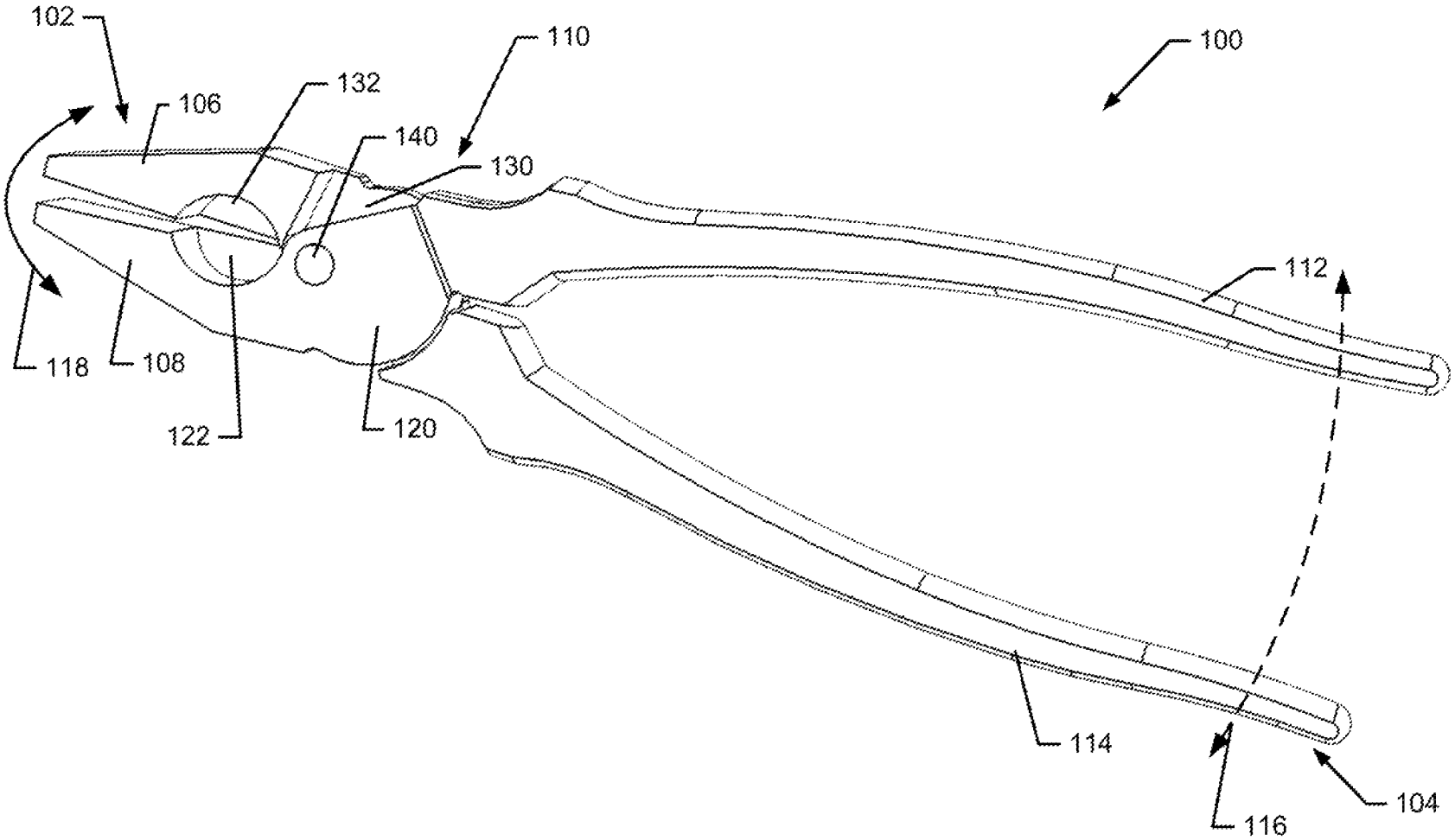
FIG. 1 illustrates a perspective view of solid joint pliers with an improved joint assembly according to an example embodiment.

Some example embodiments now will be described more fully hereinafter with reference to the accompanying drawings, in which some, but not all example embodiments are shown. Indeed, the examples described and pictured herein should not be construed as being limiting as to the scope, applicability or configuration of the present disclosure. Rather, these example embodiments are provided so that this disclosure will satisfy applicable legal requirements. Like reference numerals refer to like elements throughout. Furthermore, as used herein, the term "or" is to be interpreted as a logical operator that results in true whenever one or more of its operands are true. As used herein, operable coupling should be understood to relate to direct or indirect connection that, in either case, enables functional interconnection of components that are operably coupled to each other.

Figure 2:
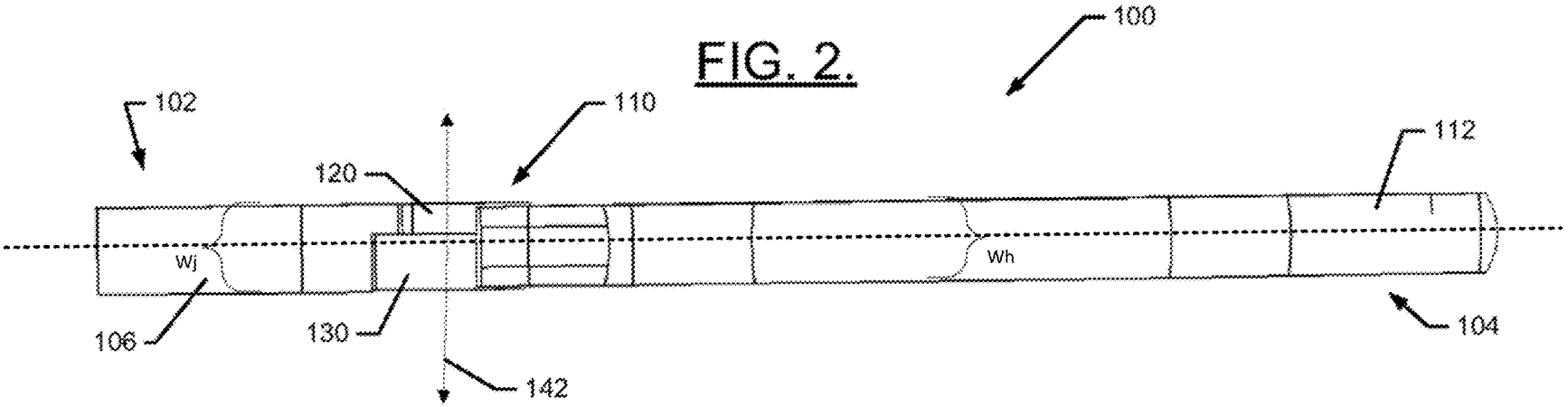
FIG. 2 is a top view of the hand tool of FIG. 1 in accordance with an example embodiment.
Figure 3:
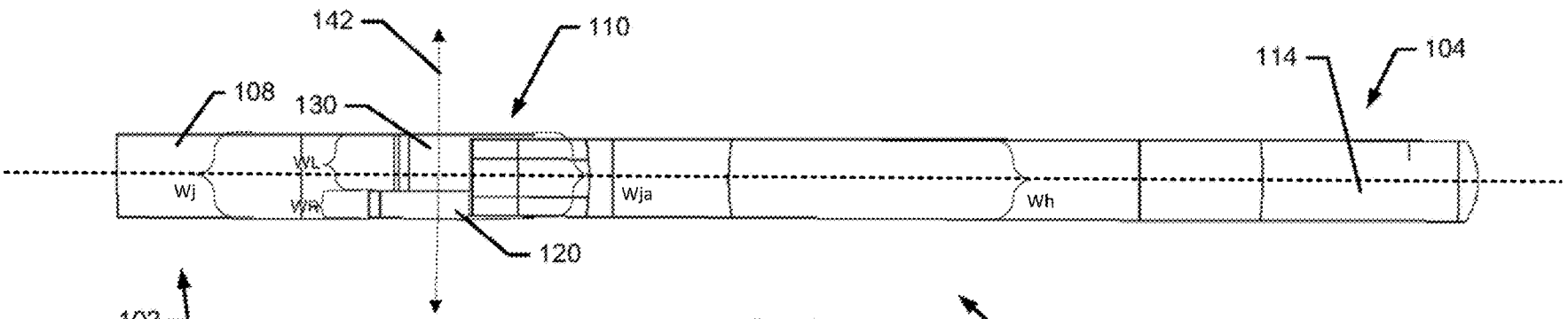
FIG. 3 is a bottom view of the hand tool of FIG. 1 in accordance with an example embodiment.
Figure 4:
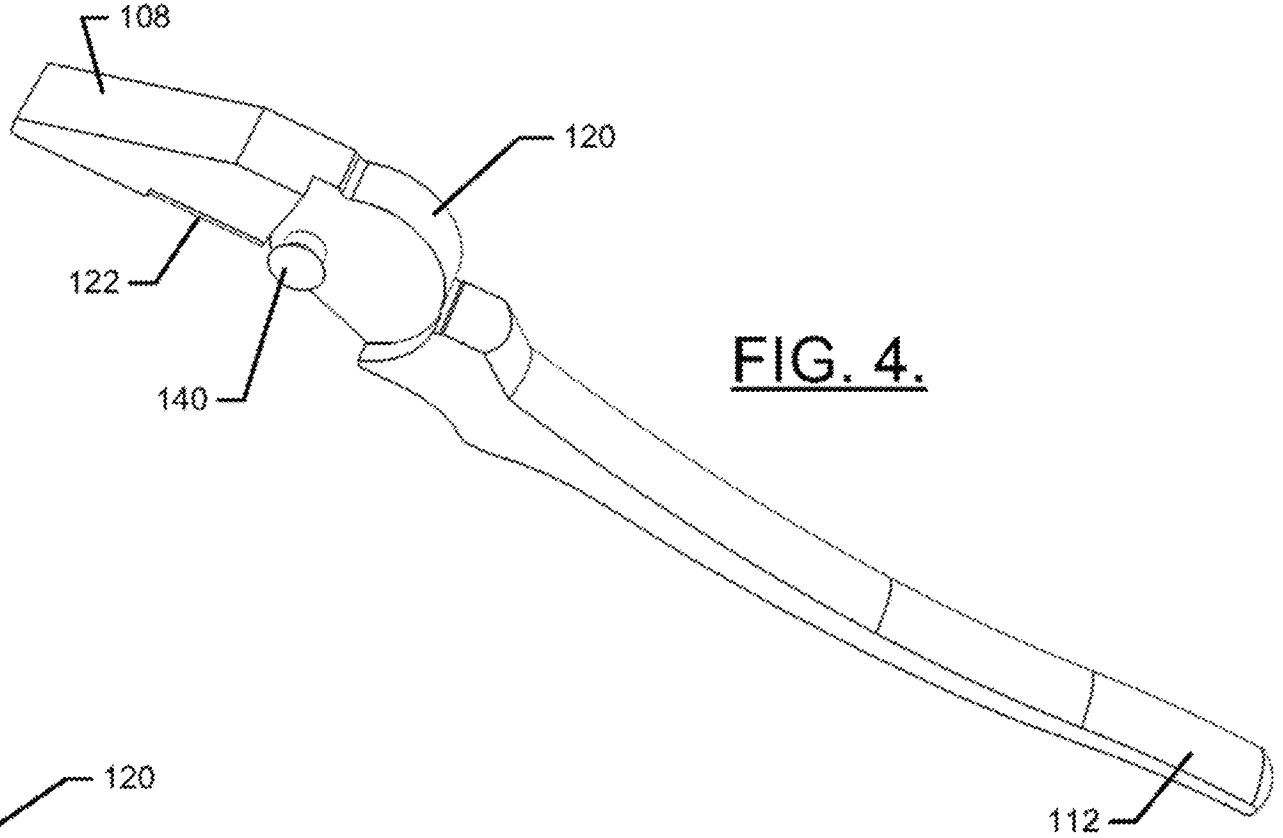
FIG. 4 is an isolated perspective view of a left transition portion of the hand tool in accordance with an example embodiment.
Figure 5:
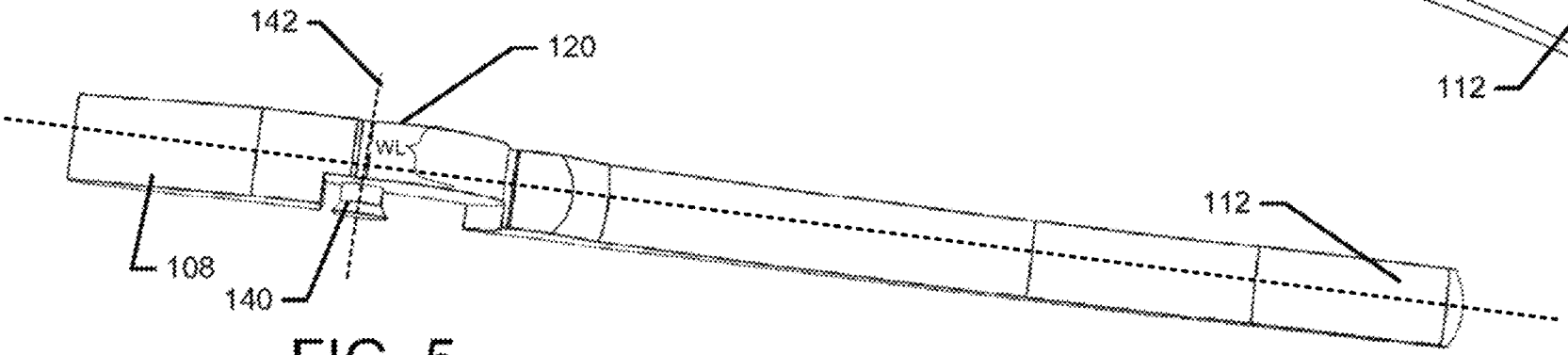
FIG. 5 is an alternative isolated perspective view of the left transition portion of the hand tool in accordance with an example embodiment.
Figure 6:
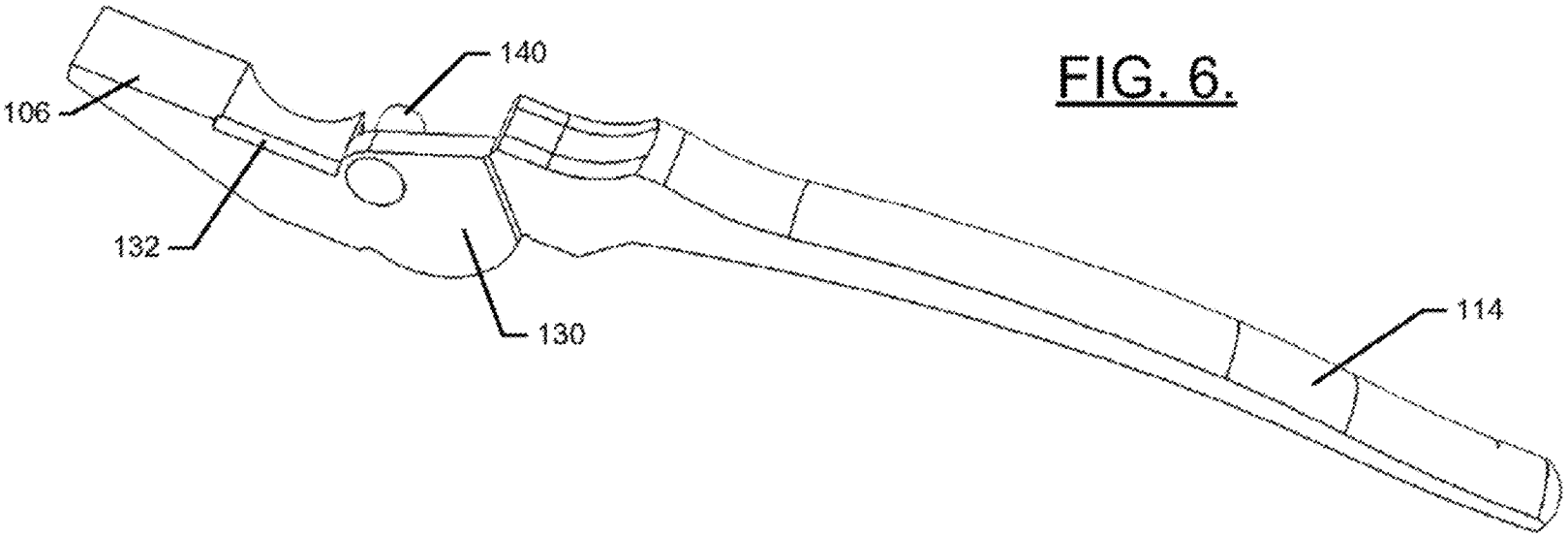
FIG. 6 is isolated perspective view of a right transition portion of the hand tool in accordance with an example embodiment.
Figure 7:
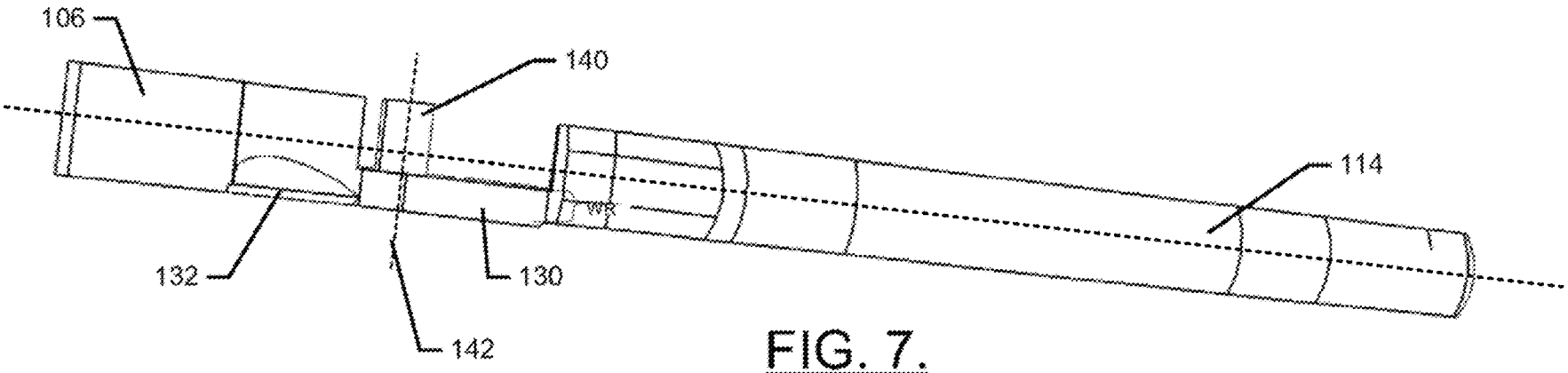
FIG. 7 is an alternative isolated perspective view of the right transition portion according to an example embodiment.

As indicated above, some example embodiments may relate to the provision of solid joint pliers that employ an improved joint design. FIGS. 1-7 show various views or portions of one such example embodiment. In this regard, FIG. 1 illustrates a perspective view of a hand tool 100 (e.g., solid joint pliers) having a joint assembly 110 of an example embodiment. FIG. 2 is a top view of the hand tool 100 of FIG. 1, and FIG. 3 is a bottom view of the hand tool of FIG. 1. FIGS. 4 and 5 are each isolated perspective views of a left transition portion 120 of the hand tool 100 of FIG. 1, while FIGS. 6 and 7 are each isolated perspective views of a right transition portion 130 of the hand tool 100 of FIG. 1.

Of note, the hand tool 100 of FIG. 1 should be understood to be positioned such that it can be bisected by a vertically oriented plane that passes through the longitudinal centerline of the hand tool 100. The terms "top," "bottom," "right," and "left" should therefore be understood as relative terms that are applicable to this particular orientation. To the extent the terms "front" and "back" are also used, the front of the hand tool 100 should be understood to be the working end thereof (i.e., the end at which the jaws are located), and the back of the hand tool 100 is the opposite end to the working end (i.e., the end at which the handles are located).

Referring now to FIGS. 1-7, the hand tool 100 may include a head section 102 and a handle section 104. The head section 102 may include a top jaw 106 and a bottom jaw 108. The head section 102 may be separated from the handle section 104 by the joint assembly 110. The handle section 104 may include a top handle 112 and a bottom handle 114. The top jaw 106 and bottom handle 114 may be formed of a rigid metallic material (e.g., iron or steel, such as induction hardened steel) and the bottom jaw 108 and the top handle 112 may be similarly formed of a rigid metallic material (e.g., the same material used to form the top jaw 106 and bottom handle 114). In an example embodiment, at least some of the metallic portions of the hand tool 100 may be covered with a corrosion resistant finish (e.g., a black-oxide finish). Lengths of the top jaw 106 and bottom handle 114 and of the bottom jaw 108 and the top handle 112 may be selected to provide any desirable length for the hand tool 100.

As can be appreciated from FIGS. 1-7, for example, the top jaw 106 and bottom handle 114 may form one unitary piece of metallic material that is operably coupled to the bottom jaw 108 and the top handle 112 at the joint assembly 110. The bottom jaw 108 and the top handle 112 may also be formed from a single unitary piece of metallic material. The single unitary piece comprising the top jaw 106 and bottom handle 114 may transition between the top jaw 106 and the bottom handle 114 at a transition portion that is located substantially on the right side of the above-mentioned vertically oriented plane, and may therefore be referred to as the right transition portion 130 of the hand tool 100 and is shown in FIGS. 4 and 5. The single unitary piece comprising the bottom jaw 108 and top handle 112 may transition between the bottom jaw 108 and the top handle 114 at a transition portion that is located substantially on the left side of the above-mentioned vertically oriented plane, and may therefore be referred to as the left transition portion 120 of the hand tool 100 and is shown in FIGS. 6 and 7.

Of note, the left transition portion 120 of a conventional pliers may be referred to as a left half, and the right transition portion 130 of the conventional pliers may be referred to as a right half. In such a context, the widths of the right and left halves are normally equal, and thus the term "half" may accurately represent the proportion of the total width of the pliers at its joint assembly that each such transition portion actually represents. Meanwhile, as will be explained in greater detail below, some example embodiments may employ transition portions of unequal width, and therefore the more general term of "portion" will be employed instead of the term "half". However, some example embodiments described herein could also be employed with right and left transition portions 130 and 120 that may have equal widths as well. As such, the term "transition portion" should be understood to encompass both embodiments that have equal widths and those with different widths when no specific width description is provided for such embodiments.

Separating the top handle 112 from the bottom handle 114 (i.e., by moving them in the direction shown by arrow 116) may cause the right transition portion 130 to pivot relative to the left transition portion 120 and correspondingly pivot the top jaw 106 away from the bottom jaw 108 as shown by arrow 118. Compressing the top handle 112 toward the bottom handle 114 (i.e., by moving them in the direction opposite the direction shown by arrow 116) may cause the right transition portion 130 to pivot relative to the left transition portion 120 and correspondingly pivot the top jaw 106 toward the bottom jaw 108 (i.e., in a direction opposite the direction shown by arrow 118). The right transition portion 130 and left transition portion 120 may pivot relative to each other about a pivot pin 140 that may form a pivot axis 142 (which extends through an axial centerline of the rivet 140). The pivot pin 140 may be passed through an axial orifice that is formed in each of the left and right transition portions 120 and 130. The axial orifices of the left and right transition portions 120 and 130 may be aligned (coaxial with the pivot axis 142) before the pivot pin 140 is passed therethrough.

As shown in FIG. 1, the top jaw 106 and the bottom jaw 108 may each be formed to include a cutting portion disposed between a distal end of respective ones of the top jaw 106 and the bottom jaw 108 and the joint assembly 110. Thus, for example, a bottom cutter 122 may be formed between the left transition portion 120 and the bottom jaw 108, and a top cutter 132 may be formed between the right transition portion 130 and the top jaw 106. The top cutter 132 and the bottom cutter 122 may be arranged to meet each other at respective sharpened edges thereof to provide a cutting or pinching action with the meeting of the sharpened edges when the top jaw 106 and bottom jaw 108 are clamped together. Of note, the top cutter 132 and the bottom cutter 122 of an example embodiment are disposed entirely on a right side of the above mentioned vertical plane. As such, the top cutter 132 is disposed entirely on the same side of the vertical plane as the right transition portion 130. However, the bottom cutter 122 is actually disposed on an opposite side of the vertical plane than the side of the vertical plane on which a majority portion of the left transition portion 120 is located.

In an example embodiment, the top jaw 106 and the bottom jaw 108 may each have the same width (Wj), and the top handle 112 and bottom handle 114 may also have the same width (Wh). Moreover, in some cases, the widths of the handles and jaws may also be substantially equal (i.e., Wj=Wh). However, in the example shown, the width of the jaws (Wj) may be slightly larger than a wide of the handles (Wh). The joint assembly 110 may also have the same overall width (Wja) as the widths of the jaws (i.e., Wja=Wj). However, in accordance with some example embodiments, the width (Wja) of the joint assembly 110 may be defined by making the left transition portion 120 and right transition portion 130 such that they have unequal widths. In an example embodiment, a width (WL) of the left transition portion 120 may be greater than a width (WR) of the right transition portion 130. The difference in width that is defined between the width (WL) of the left transition portion 120 and the width (WR) of the right transition portion 130 may be significant for preserving the operational integrity and useful life of the hand tool 100. In particular, by employing different widths for the width (WL) of the left transition portion 120 and the width (WR) of the right transition portion 130, the stresses placed on the pivot pin 140 may be reduced, and both wear on and damage to the pivot pin 140 may be reduced.

In this regard, when the hand tool 100 is used to cut an object that is placed between the top cutter 132 and bottom cutter 122, various forces are placed on the pivot pin 140 to test the strength of the pivot pin 140. For example, the pivot pin 140 undergoes bending forces as well as forces that test the tensile strength and shear strength of the pivot pin 140. Because the top cutter 132 is disposed entirely on the same side of the vertical plane as the right transition portion 130 while the bottom cutter 122 is disposed on the opposite side of the vertical plane relative to the left transition portion 120, the tensile stress is unaffected by any modification to the width (WL) of the left transition portion 120 and the width (WR) of the right transition portion 130. However, for both the bending force on the pivot pin 140 and the shear force on the pivot pin 140, the width (WR) of the right transition portion 130 (i.e., the width of the transition portion on the same side as the cutters) defines the length of the lever arm used to calculate the magnitude of the corresponding forces. Accordingly, by reducing the width (WR) of the right transition portion 130 relative to the width (WL) of the left transition portion 120, the bending and shear forces experienced by the pivot pin 140 may be reduced. Thus, when the cutters are positioned on one side of the longitudinal centerline of the hand tool 100, the width of the transition portion on the same side as the cutters may be reduced relative to the width of the transition portion on the opposite side of the cutters (relative to the longitudinal centerline) in order to reduce bending and shear stresses and extend the life of the pivot pin 140 and therefore also the hand tool 100. In an example embodiment, it may be desirable to make the smaller width (e.g., the width (WR) of the right transition portion 130) about 30% to about 90% of the larger width (e.g., the width (WL) of the left transition portion 120). Moreover, in In order to keep the width of the hand tool 100 substantially consistent along its length, it may be desirable to ensure that the pivot pin 140 does not extend either at all, or at least very much, beyond the outer surfaces of the left and right transition portions 120 and 130. The pivot pin 140 may therefore be countersunk into each of the left and right transition portions 120 and 130 so that ends of the pivot pin 140 are substantially flush with outer surfaces of the left and right transition portions 120 and 130. The pivot pin 140 can be embodied in various different ways. In order to achieve the consistent width mentioned above, it may be desirable to employ a rivet to form the pivot pin 140. However, it may also be possible to define the pivot pin 140 using a welded structure as described in greater detail below.

Figure 8:
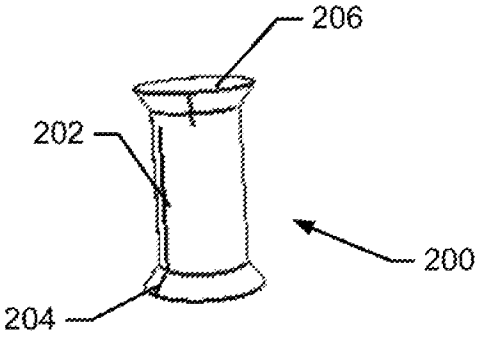
FIG. 8 illustrates a rivet that may be used to define the pivot pin of an example embodiment.
Figure 9:
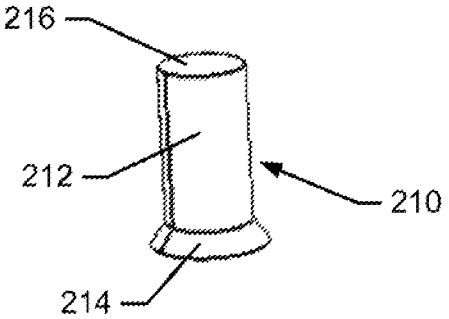
FIG. 9 illustrates a welding pin that may be used to define the pivot pin of an alternative example embodiment.
Figure 10:
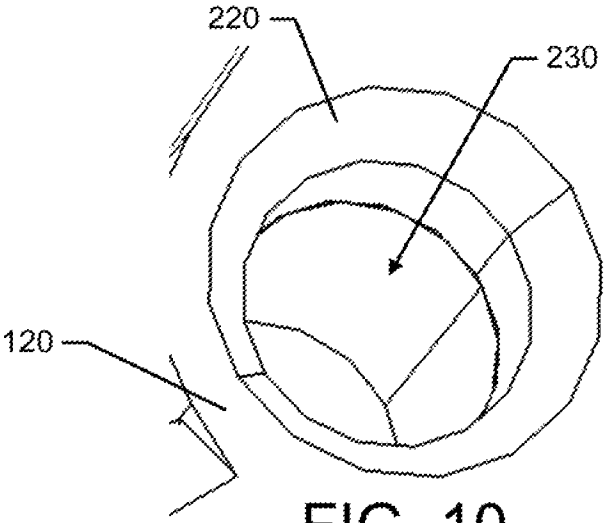
FIG. 10 illustrates a beveled edge of an axial orifice formed in an external face of one of the transition portions of the hand tool in accordance with an example embodiment.
Figure 11:
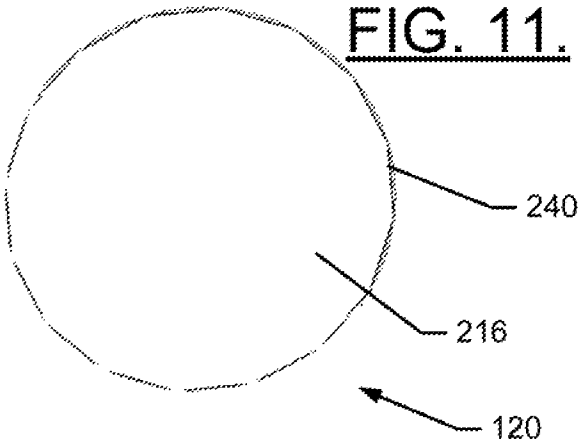
FIG. 11 illustrates a weld joint formed at the external face of one of the transition portions of the hand tool in accordance with an example embodiment.

FIG. 8 illustrates a rivet 200 that may be used to define the pivot pin 140 of an example embodiment. Meanwhile, FIG. 9 illustrates a welding pin 210 that may be used to define the pivot pin 140 of an alternative example embodiment. FIG. 10 illustrates a beveled edge 220 of an axial orifice 230 formed in an external face of one of the transition portions of the hand tool 100, and FIG. 11 illustrates a weld joint 240 formed at the external face of one of the transition portions of the hand tool 100 in accordance with an example embodiment.

As shown in FIG. 8, the rivet 200 may include a substantially cylindrically shaped base portion 202 (or shaft) and a head portion 204 at one end thereof. The head portion 204 may have a larger diameter than the base portion 202, and the head portion 204 may have a flat outer surface (that may lie in a same plane as the outer surface of the corresponding transition portion when the rivet 200 is installed). The head portion 204 may also have a gradual transition to its widest diameter and the gradual transition may match a shape of the beveled edge 220 of the axial orifice 230. In some cases, a tail 206 may be installed into the end of the base portion 202 that is opposite the head portion 204 to effectively define a head on each end of the base portion 202. The tail 206 may be otherwise shaped similarly to the head portion 204 and may fit into the axial orifice of the opposing transition portion, and may also interface with a corresponding beveled edge disposed in the opposing transition portion at its axial orifice to define the rivet 200 as a "flush rivet" or "countersunk rivet". The rivet 200 may allow both the left transition portion 120 and the right transition portion 130 to move or pivot relative to the rivet 200.

As an alternative to the use of the rivet 200, some example embodiments may employ a welding pin 210 as shown in FIG. 9. The welding pin 210 may also include a shaft 212 and head 214 that are similar to the base portion 202 and head portion 204, respectively, described above. However, no tail 206 may be needed for the welding pin 210. Instead, a fixed end 216 of the shaft 212, which is opposite the head 214, may be affixed to the corresponding transition portion to which the fixed end 216 is proximate. In particular, the weld joint 240 may be defined around a periphery of the fixed end 216 to weld the fixed end 216 to the corresponding transition portion (i.e., at an intersection of the internal periphery of the axial orifice and the exposed outer surface of the transition portion). The weld joint 240 may be formed by laser welding. However, other types of welding can also be employed in other example embodiments.

Unlike the rivet 200, which permits movement of both transition portions, when the welding pin 210 is employed, the transition portion that is proximate to the fixed end 216 does not pivot relative to the welding pin 210, but the other transition portion does. Of note, although the welding pin 210 could be used in connection with the left transition portion 120 and right transition portion 130 described above where each respective transition portion has a different width, the transition portions could also have the same width in some cases. Moreover, regardless of the widths of the transition portions, the fixed end 216 could be disposed at either of the transition portions.

As can be appreciated from the example of FIGS. 1-11, example embodiments may define a hand tool with an improved joint assembly. For example, the hand tool may include a head section having a top jaw and a bottom jaw, a handle section including a top handle and a bottom handle, and a joint assembly operably coupling the head section to the handle section. The top jaw may be operably coupled to the bottom handle by a first transition portion of the joint assembly, and the bottom jaw may be operably coupled to the top handle by a second transition portion of the joint assembly. The first and second transition portions may be pivotally coupled to each other by a pivot pin. The first transition portion may be disposed on a first side of a longitudinal centerline of the hand tool, and at least a majority of the second transition portion is disposed on a second side of the longitudinal centerline. In some cases, a width of the first transition portion in a direction of a pivot axis of the pivot pin is less than a width of the second transition portion. Alternatively or additionally, the pivot pin may include a welding pin that is welded to one of the first transition portion or the second transition portion.

The hand tool and/or its components may include a number of modifications, augmentations, or optional additions, some of which are described herein. For example, a top cutter may be disposed proximate to the top jaw, and a bottom cutter may be disposed proximate to the bottom jaw. The top and bottom cutters may each be disposed on the first side of the longitudinal centerline of the hand tool. In an example embodiment, the width of the first transition portion is about 30% to about 90% of the width of the second transition portion. In some cases, the width of the first transition portion is about 50% of the width of the second transition portion. In an example embodiment, the pivot pin may include a rivet. A head of the rivet and a tail of the rivet may each be countersunk into respective outer surfaces of the first and second transition portions. When the pivot pin comprises a welding pin, a head of the welding pin is countersunk into an outer surface of one of the first transition portion or the second transition portion. Alternatively or additionally, the welding pin may include a shaft having a head at a first end and a fixed end at the second end of the shaft. In such a case, the fixed end may be welded to the one of the first transition portion or the second transition portion. In some cases, the head and the fixed end may each be flush with a corresponding outer surface of the first transition portion and the second transition portion. In an example embodiment, the hand tool may include a solid joint pliers.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe exemplary embodiments in the context of certain exemplary combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. In cases where advantages, benefits or solutions to problems are described herein, it should be appreciated that such advantages, benefits and/or solutions may be applicable to some example embodiments, but not necessarily all example embodiments. Thus, any advantages, benefits or solutions described herein should not be thought of as being critical, required or essential to all embodiments or to that which is claimed herein. Although specific terms are employed herein, they are used in a generic and descriptive sense only and not for purposes of limitation.

That which is claimed:

1. A hand tool comprising:

a head section including a top jaw and a bottom jaw;

a handle section including a top handle and a bottom handle; and a joint assembly operably coupling the head section to the handle section, wherein the top jaw is operably coupled to the bottom handle by a first transition portion of the joint assembly, and the bottom jaw is operably coupled to the top handle by a second transition portion of the joint assembly, the first and second transition portions being pivotally coupled to each other by a pivot pin, wherein one of the first transition portion or the second transition portion is disposed entirely on a first side of a longitudinal centerline of the hand tool, and the other of the first transition portion or the second transition portion extends from an outer surface that lies in a plane containing an outer side of the transition portion's respective jaw on a second side of the longitudinal centerline across the longitudinal centerline to the first side of the longitudinal centerline, wherein a top cutter is disposed proximate to the top jaw, and a bottom cutter is disposed proximate to the bottom jaw, and wherein the top and bottom cutters are each disposed on the first side of the longitudinal centerline of the hand tool.

2. The hand tool of claim 1, wherein the width of the first transition portion is about 30% to about 90% of the width of the second transition portion.

3. The hand tool of claim 2, wherein the width of the first transition portion is about 50% of the width of the second transition portion.

4. The hand tool of claim 1, wherein the pivot pin comprises a rivet.

5. The hand tool of claim 4, wherein a head of the rivet and a tail of the rivet are each countersunk into respective outer surfaces of the first and second transition portions.

6. The hand tool of claim 1, wherein the pivot pin comprises a welding pin that is welded to one of the first transition portion or the second transition portion.

7. The hand tool of claim 6, wherein a head of the welding pin is countersunk into an outer surface of one of the first transition portion or the second transition portion.

8. The hand tool of claim 6, wherein the welding pin comprises a shaft having a head at a first end and a fixed end at the second end of the shaft, and wherein the fixed end is welded to the one of the first transition portion or the second transition portion.

9. The hand tool of claim 6, wherein the welding pin comprises a shaft having a head at a first end and a fixed end at the second end of the shaft, and wherein the head and the fixed end are each flush with a corresponding outer surface of the first transition portion and the second transition portion.

10. The hand tool of claim 1, wherein the hand tool comprises a solid joint pliers.

11. A hand tool comprising:

a head section including a top jaw and a bottom jaw;

a handle section including a top handle and a bottom handle; and a joint assembly operably coupling the head section to the handle section, wherein the top jaw is operably coupled to the bottom handle by a first transition portion of the joint assembly, and the bottom jaw is operably coupled to the top handle by a second transition portion of the joint assembly, the first and second transition portions being pivotally coupled to each other by a pivot pin, wherein one of the first transition portion or the second transition portion is disposed entirely on a first side of a longitudinal centerline of the hand tool, and the other of the first transition portion or the second transition portion extends from an outer surface that lies in a plane containing an outer side of the transition portion's respective jaw on a second side of the longitudinal centerline across the longitudinal centerline to the first side of the longitudinal centerline, and wherein the pivot pin comprises a welding pin that is welded to one of the first transition portion or the second transition portion, wherein a width of the first transition portion in a direction of a pivot axis of the pivot pin is less than a width of the second transition portion, wherein a top cutter is disposed proximate to the top jaw, and a bottom cutter is disposed proximate to the bottom jaw, and wherein the top and bottom cutters are each disposed on the first side of the longitudinal centerline of the hand tool.

12. The hand tool of claim 11, wherein the width of the first transition portion is about 30% to about 90% of the width of the second transition portion.

13. The hand tool of claim 12, wherein the width of the first transition portion is about 50% of the width of the second transition portion.

* * * * *